US005090455A

United States Patent [19]

Jankovsky et al.

[11] Patent Number: 5,090,455

[45] Date of Patent: Feb. 25, 1992

[54] DUAL TORSION BAR PICKING MECHANISM FOR A LOOM

[75] Inventors: Frantisek Jankovsky, Winterthur; Danilo Vezzu, Ruti; Erwin Pfarrwaller; Hans Demuth, both of Winterthur, all of Switzerland

[73] Assignee: Sulzer Brothers Limited, Winterthur, Switzerland

[21] Appl. No.: 600,843

[22] Filed: Oct. 15, 1990

[30] Foreign Application Priority Data

Oct. 25, 1989 [CH] Switzerland ..... 03853/89

[51] Int. Cl.[5] ..... D03D 49/32

[52] U.S. Cl. ..... 139/145

[58] Field of Search ..... 74/84 R, 54; 139/145, 139/439, 142; 267/188, 191

[56] References Cited

U.S. PATENT DOCUMENTS 2,160,338 5/1939 Moessinger ..... 139/145

2,715,422 8/1955 Pfarrwaller ..... 139/145

4,223,703 9/1980 Pfarrwaller .

FOREIGN PATENT DOCUMENTS 0333647 9/1989 European Pat. Off. .

*Primary Examiner*—Andrew M. Falik

*Attorney, Agent, or Firm*—Kenyon & Kenyon

[57] ABSTRACT

The picking mechanism is provided with two torsion bars. One torsion bar is stressed in order to accelerate a gripper projectile of the loom. The second torsion bar, upon release of the first torsion bar, is temporarily connected to the first torsion bar so that energy can be stored by the second torsion bar via a double-arm lever. During a return motion of the acceleration lever to a picking position, the second torsion bar is relieved of tension by delivering the stored energy to the drive shaft of the picking mechanism via the double arm lever. The picking mechanism thus uses only little energy.

14 Claims, 4 Drawing Sheets

DUAL TORSION BAR PICKING MECHANISM FOR A LOOM

Figure 1:
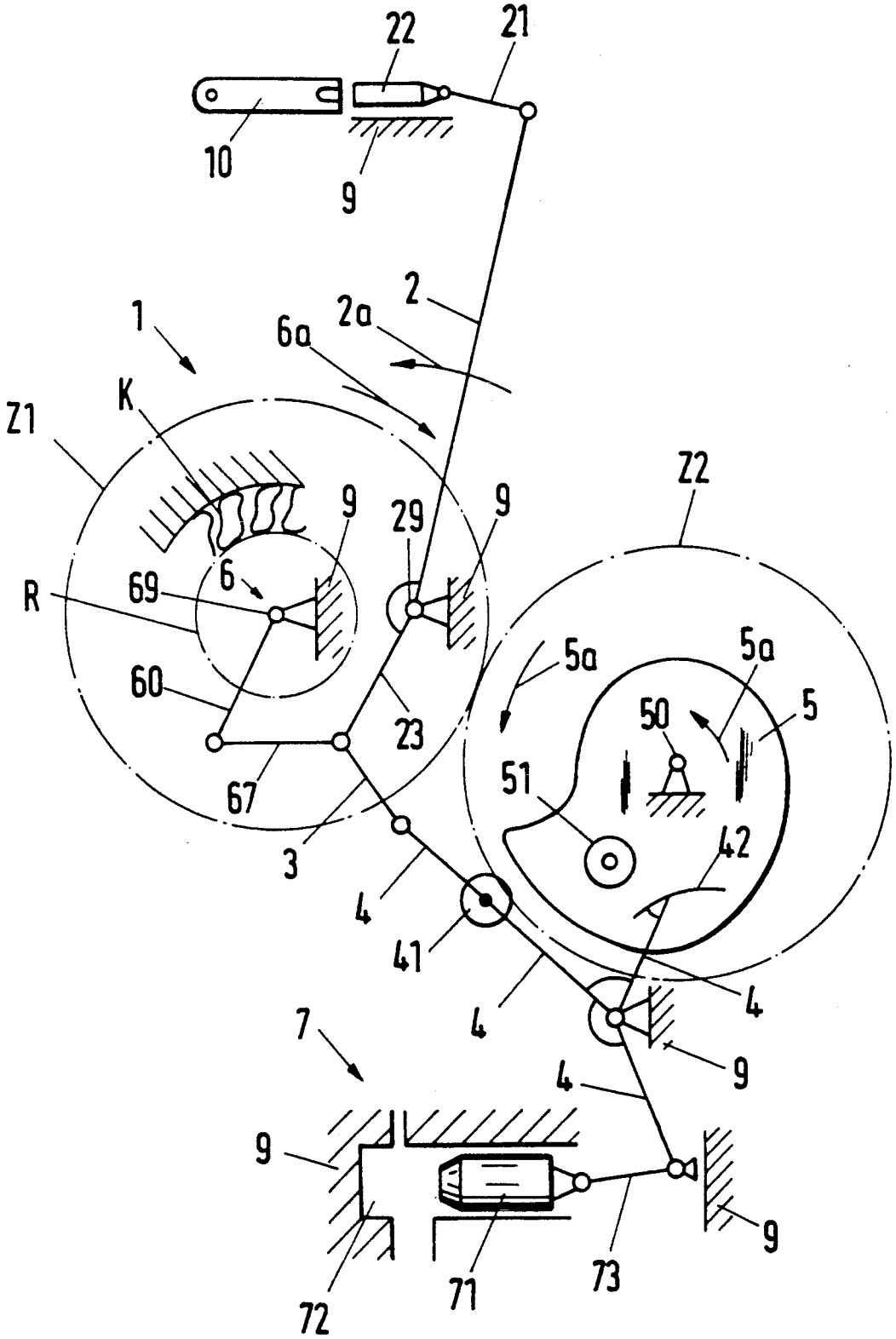

This invention relates to a picking mechanism for a loom. More particularly, this invention relates to a picking mechanism for accelerating a gripper projectile in a weaving machine.

As is known, various types of picking mechanisms have been employed for the picking of gripper projectiles in weaving machines and looms. For example, U.S. Pat. No. 4,223,703 describes a picking mechanism in which a picking lever is mounted on a torsion bar which is fixed at one end and a tensioning means which employs a cam disc for pivoting of the lever into a picking position. In this respect, the cam disc is freely rotatable in a drive direction and is disposed on a drive shaft in order to prestress the torsion bar. When the torsion bar is prestressed, the kinetic energy of the cam disc is first transmitted to a cam follower and converted into potential energy in the torsion bar. In the last phase of the tensioning process, the angular velocity of the cam disc has decreased sufficiently for the disc to be additionally rotated at a relatively constant angular speed by the drive shaft via a driver, which completely tensions the torsion bar. During the next step of relieving the tension on the torsion bar and simultaneously accelerating the projectile, the cam disc is accelerated by the cam follower after the projectile has been lifted off the acceleration lever. As a result of the angular acceleration of the cam disc, the other parts of the device are slowed down. When the torsion bar is next tensioned, the cam disc is again slowed down by transmission of energy to the cam follower and the torsion bar.

The cam disc, together with the acceleration lever, the cam follower and the torsion bar, constitutes a freely vibrating system which is briefly coupled to the drive system of the weaving machine during each weaving cycle. It has been found that driving the cam disc by the drive shaft is not free from impacts under all operating conditions, and can result in high stresses on the drive mechanisms of the weaving machine.

Accordingly, it is an object of the invention to efficiently control the recovery of energy in a picking mechanism for a loom.

It is another object of the invention to reduce vibration in a picking mechanism for a gripper projectile during operation.

It is another object of the invention to reduce internal mechanical stresses in a picking mechanism for a gripper projectile in a loom.

Briefly, the invention provides a picking mechanism for a loom which includes a spring element in the form of a torsion bar which is fixedly mounted at one end and an accelerating lever for picking of a gripper projectile in a picking direction and tensioning means for stressing the torsion bar in a direction opposite the picking direction in order to position the torsion bar in a picking position.

In accordance with the invention, a second torsion bar which is fixedly mounted at one end is provided along with a plurality of transmission elements for coupling the first torsion bar with the second torsion bar in order to twist the second torsion bar in response to movement of the acceleration lever in the picking direction so as to recover energy therefrom.

The picking mechanism also has a drive shaft which is connected to the tensioning means for driving the tensioning means so as to place the acceleration lever in a picking direction. The second torsion bar is also coupled with the drive shaft in order to impart energy thereto during movement of the acceleration lever into the picking position.

The second torsion bar serves to slow down the picking mechanism and to store at least some of the kinetic energy of the acceleration lever during picking. When this second torsion bar is coupled to the drive shaft, the potential energy of the second torsion bar can be returned to the drive shaft. As a result of coupling the second torsion bar to the 11 drive shaft, the energy of the second torsion bar is returned in controlled manner in each phase of motion, since the speed of the second torsion bar during release of tension will depend on the angular velocity of the drive shaft. The mechanism is therefore prevented from free vibration during return of the recovered energy to the first torsion bar. Also, the picking mechanism is impact-free under all operating conditions. This reduces the vibration on the entire drive of the weaving machine. The picking mechanism also has lower internal mechanical stresses.

In one embodiment, the transmission elements between the two spring elements or torsion bars includes a crank arm connected to the lever in non-rotatable manner and a cam segment which is connected with the crank arm for rotation therewith. In addition, a rocker arm is mounted on the drive shaft for releasably engaging the crank arm in order to pivot the crank arm during rotation of the drive shaft and during movement of the acceleration lever into the picked position. Still further, a double-arm lever is fixedly mounted on a second torsion bar and carries a roller for rolling on the cam segment in order to pivot the double-arm lever and to stress the second torsion bar during movement of the accelerating lever in the picking direction.

A second cam segment is also mounted on the drive shaft for rotation therewith while a second roller is mounted on the double-arm lever for rolling on this second cam segment during movement of the acceleration lever in a direction opposite the picking direction.

When the first cam segment runs against the roller on the first arm of the double arm lever before the end of the tension-releasing process, the energy of the first torsion bar or the kinetic energy of the system is transmitted to the second torsion bar. When the second torsion bar pivots back, the previously transmitted residual energy is returned to the drive shaft by the transmission elements, i.e. the roller on the second arm of the double-arm lever and the associated second cam segment. During the next process of tensioning the lever, the drive shaft supplies the returned energy to the first torsion bar, on the one hand via the rocker arm and on the other hand via the tensioning means which may include a cam plate and a cam follower.

In a second embodiment of the device, the energy stored by the second torsion bar is returned on the one hand directly to the first torsion bar via the rocker arm and on the other hand to the drive shaft via a friction wheel, unidirectionally acting clamping members and gearwheels.

Figure 2:
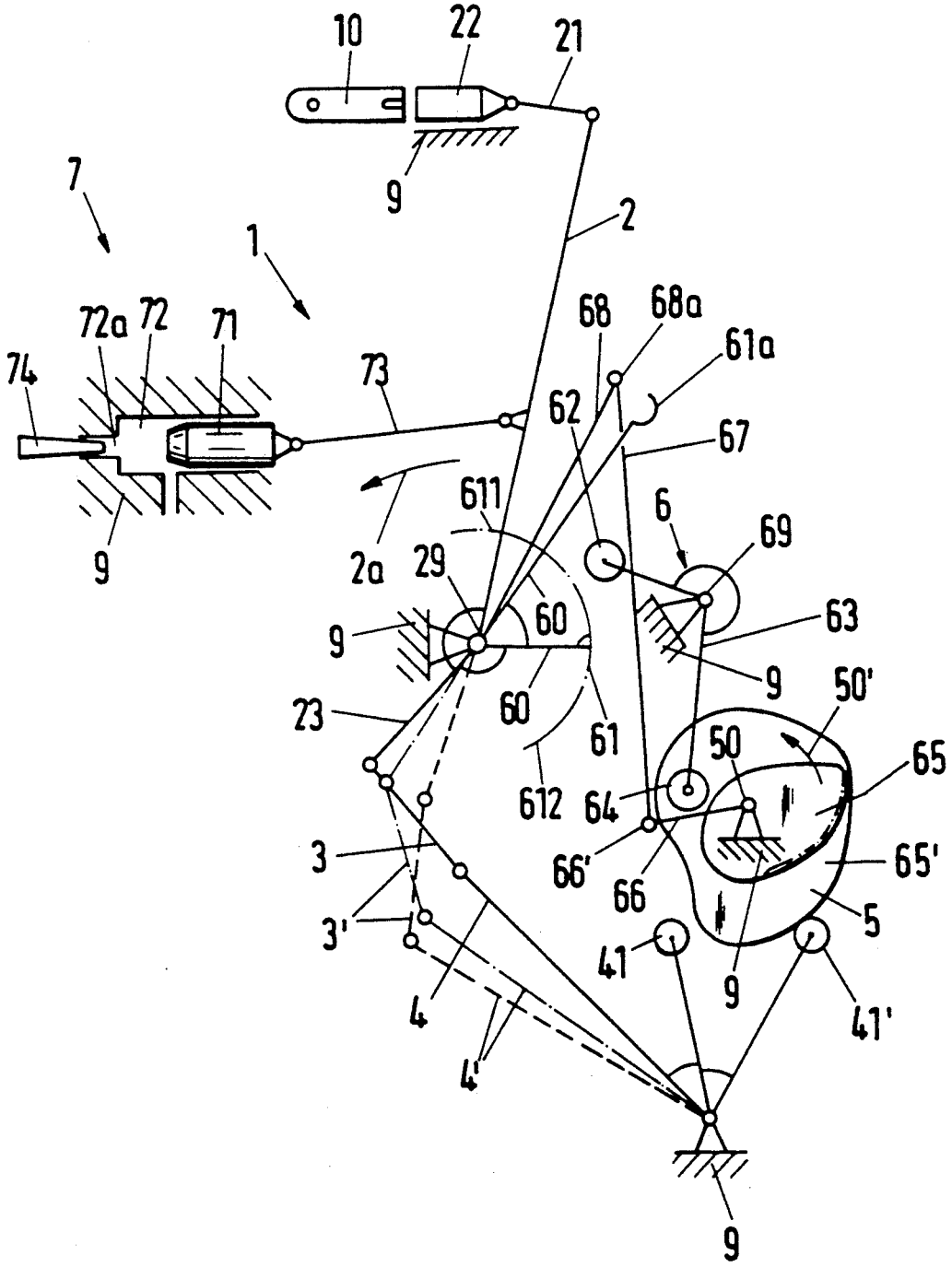
Figure 2A:
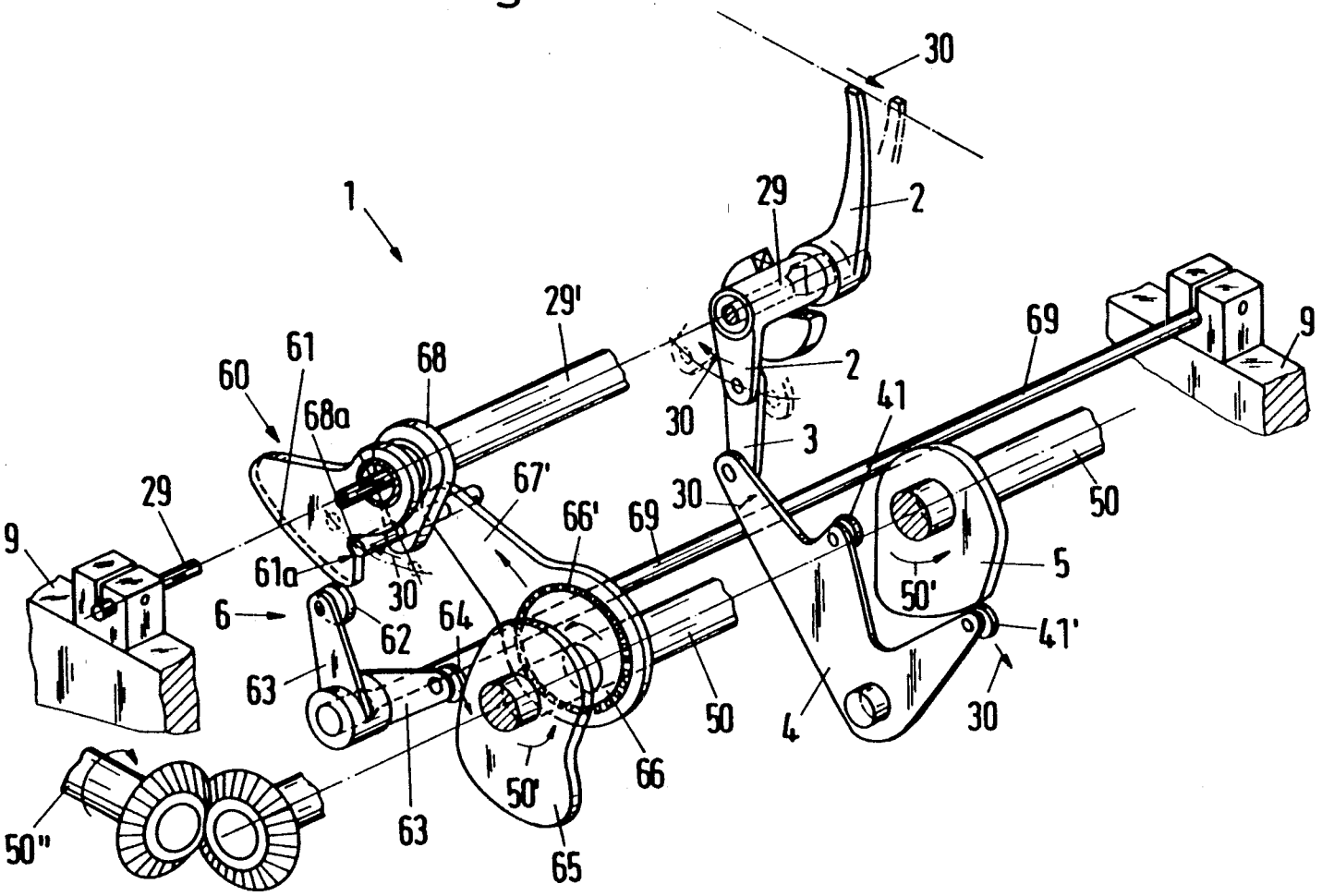
Figure 2B:
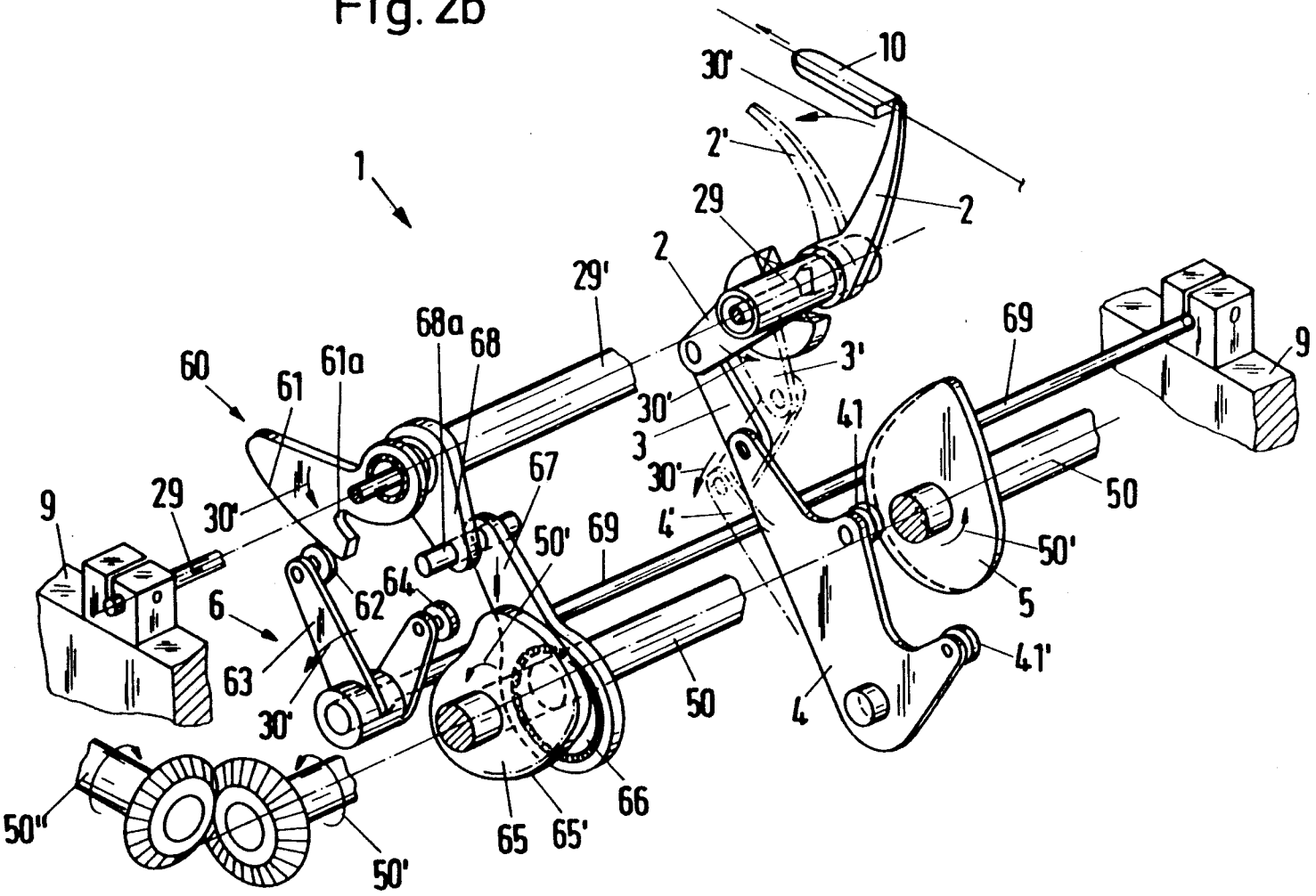

These and other objects and advantages of the invention will become more apparent from the following detailed description taken in conjunction with the accompanying drawings wherein:

FIG. 1 schematically illustrates a picking mechanism layout in accordance with the invention;

FIG. 2 schematically illustrates a modified picking mechanism constructed in accordance with the invention;

FIG. 2*a* illustrates a perspective view of the picking mechanism of FIG. 2; and FIG. 2*b* illustrates the picking mechanism of FIG. 2*a* in another operating position in accordance with the invention.

Referring to FIG. 1, the picking mechanism 1 includes an acceleration lever 2 for picking of a gripper projectile 10. The acceleration lever 2 is illustrated in a picking position and is mounted on the spring element 29 in the form of an elongated torsion rod which is fixedly mounted at one end in a casing 9. At one end, the lever 2 is connected by a link 21 to a picker 22 which is guided in the casing 9 in order to pick the gripper projectile 10. At the opposite end, the lever 2 has an arm 23 which is connected to a tensioning means for stressing the torsion bar 29 in a direction opposite the picking direction.

As illustrated, the tensioning means is similar to that as described in EPA 0333 647 and includes a link which is pivotally mounted to the lever arm 23 and a cam follower 4 which is pivotally connected to the opposite end of the link 3. In this respect, both the lever 2 and the cam follower 4 are mounted on the casing 9. As indicated, the cam follower 4 is pivotally mounted in the casing 9 and carries a cam roller 41 for engaging with a cam plate 5 rotatably mounted on the drive shaft 50 of the weaving machine. As indicated by the arrow 5*a*, the cam plate 5 is rotated in a counter-clockwise manner by the drive shaft 50. In addition, the cam plate 5 is shaped so as to engage against the roller 41 during specified angles of rotation of cam plate 5. In each weaving cycle, the torsion bar 29 is tensioned by the cam plate 5 which continuously rotates with the shaft 50 and, via the periphery of the cam plate 5, pivots the cam follower counter-clockwise via the roller 41.

As illustrated in FIG. 1, an oil brake 7 is pivoted to the cam follower 4 and comprises a link 73 and a piston 71 which is guided in an oil-filled chamber in the casing 9. The piston 71 is arranged to slide into a stagnant oil-filled chamber 72 shortly before the picking mechanism 1 comes to a stop, thus, slowing down the picking mechanism by displacing oil from the chamber 72.

In order to recover part of the kinetic energy of the picking mechanism, a second spring element in the form of a torsion bar 69 is fixedly mounted at one end to the casing 9 and mechanical transmission elements are provided for coupling the torsion bar 69 to the first torsion bar 29. As illustrated, the mechanism transmission elements include a crank arm 60 secured on an axis of rotation to one end of the torsion bar 69 and a rocker arm 67 which is pivotally connected to and between the crank arm 60 and the lever arm 23. Thus, during the release of tension on the first torsion bar 29, the second torsion bar 69 is tensioned and, thus, takes up part of the kinetic energy of the picking mechanism while slowing the picking mechanism. In the process, there is only slight stress on the oil brake 7 and, consequently, on the other components of the mechanism 1.

Before the next pick, the first torsion bar 29 is tensioned by the cam plate 5 until the cam follower 4 comes into abutment with the casing 9.

As illustrated, a curved sector 42 is formed on the cam follower 4 and comes into contact with a roller 51 rotatably mounted on the cam plate 5 during rotation of the cam plate and after tensioning of the first torsion bar 29. In the process, the cam follower 4 is pivoted clockwise, thus, initiating the release of tension in the torsion bar 29. The acceleration lever 2 then pivots counter-clockwise about an axis of rotation while the projectile 10 is picked by the picker 22.

In order to recover substantially all the kinetic energy of the system, additional drive elements can be provided, e.g. in the form of a pair of gearwheels Z1 and Z2. The first gearwheel Z1 is freely rotatable on the axis of the torsion bar 69 and the second gearwheel Z2 is non-rotatably connected to the shaft 50. The two gearwheels Z1, Z2 intermesh at the speed of rotation of the shaft 50. A friction wheel R is non-rotatably coupled to the torsion bar 69. When the torsion bar 29 is relieved of tension and the torsion bar 69 is simultaneously tensioned, the friction wheel R rotates in the direction indicated by the arrow 2*a* for the same distance as the crank arm 60 is pivoted. After the torsion bar 69 has been 23 tensioned in the direction of arrow 2*a*, the bar 69 tends to move in the clockwise direction, thus rotating the friction wheel R backwards in the same direction. In this respect, uni-directional clamping members K are disposed between friction wheel R and the inside of the gearwheel Z1 to prevent the torsion bar 69 from moving by rotating around its axis at a greater angular speed than the angular velocity of the gearwheel Z1. Consequently, the potential energy in torsion bar 69 is partly returned to the drive of the weaving machine as kinetic energy to the shaft 50, through friction wheel R, clamping member K, gearwheel Z1 and gearwheel Z2, and partly returned directly through rocker arm 67 to the torsion bar 29.

The acceleration lever 2, the rocker arm 67, the crank arm 60 and the torsion bars 29 and 69 secured thereto pivot backwards in the opposite direction to arrow 2*a* until there is equilibrium of forces between torsion bar 29 and torsion bar 69. As soon as the angular velocity of friction wheel R during the movement of torsion bar 69 is less than the angular velocity of gearwheel Z1, no further energy is transmitted by clamping members K to gearwheel Z1.

The torsion bar 69 and transmission elements coupled therewith serve to form an energy store 6.

Referring to FIG. 2, wherein like reference characters indicate like parts as above, the picking mechanism may be constructed so that the crank arm 60 is fixedly connected to the acceleration lever 2 and carries a cam segment 61. As illustrated in FIG. 2*a*, the transmission elements also include a double-arm lever 63 which is fixedly mounted on the second torsion bar 69 at an end opposite the casing 9. This double-arm lever 63 has a roller 62 carried on one arm for rolling on the cam segment 61 in order to pivot the double-arm lever 63 and, thus, to stress, i.e. twist, the torsion bar 69 ring during movement of the acceleration lever 2 in the picking direction. During this time, the cam segment 61 rotates in a counter-clockwise manner around the axis of the first torsion bar 29. That is, after picking of the projectile 10 (see FIG. 2), the cam segment 61 transmits the kinetic energy of the mechanism through the roller 62 and double-arm lever 63 partly to the torsion bar 69 and partly to the casing 9.

After the torsion bar has been tensioned, the stored potential energy may be returned to the weaving machine and to the picking mechanism 1. To this end, the double-arm lever 63 carries a second roller 64 on an arm for rolling on a cams segment 65 fixedly mounted on the drive shaft 50 for rotation therewith. Thus, the roller 64 serves to exert a torque on the cam segment 65 over a part of the periphery of the cam segment 65, as indicated by chain-dotted lines in FIG. 2.

As illustrated in FIG. 2, a crank in the form of an eccentric 66 is fixedly mounted on the drive shaft 50 in order to move the rocker arm 67 in a reciprocating manner via a bearing 66'. At the opposite end, the rocker arm 67 is connected to a lever 68 which is mounted for free rotation around the axis of the torsion bar 29. In addition, a driver 68*a* is mounted on the end of the rocker rod 67 for engaging on a bearing surface 61*a* of the crank arm 60. During rotation of the eccentric 66, the rocker arm 67 is displaced so as to releasably engage the driver 68*a* with the bearing surface 61*a* of the crank arm 60 so as to rotate the crank arm clockwise manner (as viewed in FIG. 2*a*). The crank arm 60 is fixedly connected to the acceleration lever 2 so that the lever 2 is pivoted clockwise after the driver 68*a* abuts the bearing surface 61*a* and the rocker arm 67 continues to move in the tensioning direction. The system is thus tensioned.

Towards the end of the tensioning process, the cam disc 5 also plays a part, in that the disc 5 additionally pivots the cam follower 4 via the roller 41. FIG. 2 shows the device during the tensioning of the torsion bar 29. In order to initiate the release of tension, a roller 41' is provided on the cam follower 4, and is pivoted by the cam plate together with the cam follower 4. Positions 3' and 4' of picking mechanism 1 show various phases of motion during expansion.

The cam segment 51 has two circular portions 611, 612 (shown chain-dotted in FIG. 2) at a constant distance from the axis of rotation of the torsion bar 29. In the tensioned position, the torsion bar 69 is locked with portion 612.

An oil brake 7 is suspended on the acceleration lever 2, as on the cam follower 4 shown in FIG. 1. The oil brake 7 also has a bore 72*a* on an oil-filled chamber 72, which an be closed to a varying extent by an adjusting needle 74. The oil brake 7 is for slowing down the device during the last phase of motion after accelerating the projectile 10 and after recovery of energy.

Referring to FIG. 2*a*, wherein like reference characters indicate like parts as above, during operation of the picking mechanism, the drive shaft 50 is driven in a counter-clockwise manner as indicated by the arrow 50' by a loom shaft 50''. A picking mechanism is shown during the tensioning process. During this time, the acceleration lever 2 moves from the continuous-line position to the chain-dotted position. The crank drive comprising rocker arm 67' and crank 66 is pressing the driver 68*a* against the crank arm 60 and has nearly reached a top dead position The crank arm 60, a tensioning tube 29' connecting the cam segment 61 to the lever 2, the acceleration lever 2 and other components are pivoted in the tensioning direction as per arrows 30. After the rocker arm 67 passes the dead-center position, the mechanism is additionally tensioned by the cam plate 5 cooperating with roller 41, until the joint between the cam follower 4 and link 3 has passed the dead center position. Advantageously, a cam plate 5 is provided for each roller 41 and 41' in order to reliably guide the cam follower 4.

FIG. 2*b* shows the picking mechanism 1 in the tensioned state before picking, i.e. before the process of accelerating the projectile 10 via the acceleration lever 2. When the tension on the torsion bar 29 is released, the acceleration lever 2, the link 3, and the cam follower 4 move from the continuous-line position into the chain-dotted position 2', 3', 4', i.e. the "bent position". In the process, the acceleration lever 2, the tensioning tube 29' and the cam segment 61 are moved in the direction of arrow 30'. The double lever 63 is then also driven anti-clockwise by the cam segment 61, and the torsion bar 69 is pivoted.

During the subsequent reverse pivoting of the torsion bar 69 in the clockwise direction, the roller 64 of the double lever 63 rolls on the chain-dotted contour 65' of cam plate 65, and the shaft 50 is driven in the direction indicated by the arrow 50'. During the next process of tensioning the torsion bar 29, the energy returned by the torsion bar 69 is practically used up by the eccentric 66 on the shaft 50 and the cam plate 5, so that the weaving-machine drive, via shaft 50'', needs to replace only the energy lost by friction in the brake 7 and the energy transmitted to the projectile 10.

The invention thus provides a picking mechanism in which the process of energy recovery is efficiently controlled. The picking mechanism is also prevented from free vibration during the return of the recovered energy to the torsion bar for pivoting of the acceleration lever.

What is claimed is:

1. A picking mechanism for a loom comprising an acceleration lever for picking of a gripper projectile;

a first spring element connected to said lever for biasing said lever in a picking direction;

a tensioning means for stressing said spring in a direction opposite said picking direction;

a drive shaft for actuating said tensioning means;

a second spring element for slowing movement of said lever in said picking direction while receiving kinetic energy therefrom; and mechanical transmission elements for coupling said second spring element to said drive shaft during movement of said lever in said picking direction to impart energy thereto.

2. A picking mechanism as set forth in claim 1 wherein said tensioning means includes a cam plate mounted on said drive shaft for rotation therewith, a cam follower in contact with said cam plate for pivoting about a fixed axis and a link pivotally connected between and to said cam follower and said lever.

3. A picking mechanism as set forth in claim 1 wherein said second spring element is a torsion bar.

4. A picking mechanism as set forth in claim 3 wherein said transmission elements include a crank arm connected to said lever, a rocker arm mounted on said drive shaft for releasably engaging said crank arm to pivot said crank arm during rotation of said drive shaft and movement of said lever into said picking position, a cam segment connected with said crank arm for rotation therewith, a double-arm lever fixedly mounted on said torsion bar, and a roller on said double-arm lever for rolling on said cam segment to pivot said double-arm lever and to stress said torsion bar during movement of said lever in said picking direction.

5. A picking mechanism as set forth in claim 4 wherein said transmission elements include a second cam segment mounted on said drive shaft for rotation therewith, and a second roller mounted on said double-arm lever for rolling on said second cam segment during movement of said lever in a direction opposite said picking direction.

6. A picking mechanism as set forth in claim 4 which further comprises an eccentric mounted on said drive shaft, a bearing journalling said rocker arm on said, eccentric and a driver mounted on one end of said rocker arm for engaging on a bearing surface of said crank arm for tensioning of said lever.

7. A picking mechanism as set forth in claim 1 wherein said second spring element is a torsion bar and said transmission elements include a first gearwheel mounted on said shaft, a second gearwheel mounted on an axis of said torsion bar in meshing engagement with said first gearwheel, a friction wheel fixedly mounted on said torsion bar for rotation therewith, and unidirectional clamping members between said friction wheel and said second gearwheel.

8. A picking mechanism for a loom comprising
a first torsion bar fixedly mounted at one end;
an acceleration lever mounted on said rod for picking of a gripper projectile in a picking direction;
tensioning means for twisting said torsion bar in a direction opposite said picking direction to position said torsion bar in a picking position;
a second torsion bar fixedly mounted at one end; and
transmission elements for coupling said first torsion bar with said second torsion bar to twist said second torsion bar in response to movement of said lever in said picking direction to recover energy therefrom.

9. A picking mechanism as set forth in claim 8 which further comprises a drive shaft connected to said tensioning means for driving said tensioning means.

10. A picking mechanism as set forth in claim 9 wherein said second torsion bar is coupled with said drive shaft to impart energy thereto during movement of said lever into said picking position.

11. A picking mechanism as set forth in claim 9 wherein said tensioning means includes a cam plate mounted on said drive shaft for rotation therewith, a cam follower in contact with said cam plate for pivoting about a fixed axis and a link pivotally connected between and to said cam follower and said lever.

12. A picking mechanism as set forth in claim 9 which further comprises a crank arm connected to said lever, a rocker arm mounted on said drive shaft for releasably engaging said crank arm to pivot said crank arm during rotation of said drive shaft and movement of said lever into said picking position, a cam segment connected with said crank arm for rotation therewith, a double-arm lever fixedly mounted on said second torsion bar, and a roller on said double-arm lever for rolling on said cam segment to pivot said double-arm lever and to stress said second torsion bar during movement of said lever in said picking direction.

13. A picking mechanism as set forth in claim 12 wherein said transmission elements include a second cam segment mounted on said drive shaft for rotation therewith, and a second roller mounted on said double-arm lever for rolling on said second cam segment during movement of said lever in a direction opposite said picking direction.

14. A picking mechanism as set forth in claim 13 which further comprises an eccentric mounted on said drive shaft, a bearing journalling said rocker arm on said eccentric and a driver mounted on one end of said rocker arm for engaging on a bearing surface of said crank arm for tensioning of said lever.

* * * * *

UNITED STATES PATENT AND TRADEMARK OFFICE

CERTIFICATE OF CORRECTION

PATENT NO. : 5,090,455

DATED : February 25, 1992

INVENTOR(S) : Jankovsky et al.

It is certified that error appears in the above-identified patent and that said Letters Patent is hereby corrected as shown below:

Column 2, line 12, delete "11"

Column 3, line 44, change "thus," to --thus--

Column 4, line 2, change "thus," to --thus-- line 67, change "cams" to --cam--

Column 5, lines 15 and 16, change "clockwise manner" to --in a clockwise manner-- line 39, change "an" (first occurrence) to --can--

Column 7, line 3, change "said," to --said--

Signed and Sealed this

Thirty-first Day of August, 1993

Bruce Lehman

*Attest:*

BRUCE LEHMAN

*Attesting Officer*

*Commissioner of Patents and Trademarks*